US010063005B2

(12) United States Patent
Zhao

(10) Patent No.: US 10,063,005 B2
(45) Date of Patent: Aug. 28, 2018

(54) WATERPROOF ELECTRICAL CONNECTOR HAVING INSULATIVE SHELL INTERFERING WITH MEITALLIC SHELL

(71) Applicant: FOXCONN INTERCONNECT TECHNOLOGY LIMITED, Grand Cayman (KY)

(72) Inventor: Jun Zhao, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/873,257

(22) Filed: Jan. 17, 2018

(65) Prior Publication Data

US 2018/0205172 A1 Jul. 19, 2018

(30) Foreign Application Priority Data

Jan. 17, 2017 (CN) ..... 2017 2 0060403 U

(51) Int. Cl.

| | |
|---|---|
| ***H01R 13/52*** | (2006.01) |
| ***H01R 13/516*** | (2006.01) |
| ***H01R 13/6585*** | (2011.01) |
| ***H01R 24/60*** | (2011.01) |
| ***H01R 43/00*** | (2006.01) |
| *H01R 13/40* | (2006.01) |
| *H01R 107/00* | (2006.01) |

(52) U.S. Cl.

CPC ..... *H01R 13/5202* (2013.01); *H01R 13/516* (2013.01); *H01R 13/5216* (2013.01); *H01R 13/5219* (2013.01); *H01R 13/5227* (2013.01); *H01R 13/6585* (2013.01); *H01R 24/60* (2013.01); *H01R 43/005* (2013.01); *H01R 13/40* (2013.01); *H01R 2107/00* (2013.01)

(58) Field of Classification Search

CPC ..... H01R 13/5202; H01R 13/516; H01R 13/5216; H01R 13/5219; H01R 13/5227; H01R 13/6585; H01R 24/60; H01R 43/005

USPC ..... 439/271, 607.35, 660

See application file for complete search history.

(56) References Cited

U.S. PATENT DOCUMENTS

| | | | | |
|---|---|---|---|---|
| 8,801,163 | B2 * | 8/2014 | Asauchi | B41J 2/17526 347/86 |
| 9,112,299 | B2 * | 8/2015 | Lu | H01R 13/5227 |
| 9,385,484 | B2 * | 7/2016 | Chen | H01R 13/6594 |
| 2017/0317443 | A1 | 11/2017 | Wang | |
| 2017/0338585 | A1 | 11/2017 | Wang | |

* cited by examiner

*Primary Examiner* — Khiem Nguyen

(74) *Attorney, Agent, or Firm* — Wei Te Chung; Ming Chieh Chang

(57) ABSTRACT

An electrical connector includes an insulative housing, a metallic shielding shell enclosing the housing, and an insulative shell enclosing the metallic shielding shell. The metallic shielding shell forms a first mating cavity. The insulative shell includes a round rib protruding from an inner sidewall of the insulative shell. The round rib and the metallic shielding shell interfere with each other.

13 Claims, 9 Drawing Sheets

WATERPROOF ELECTRICAL CONNECTOR HAVING INSULATIVE SHELL INTERFERING WITH MEITALLIC SHELL

FIELD OF THE DISCLOSURE

The invention is related to a waterproof electrical connector, and particularly to an electrical connector having an insulative shell interfering with a metallic shielding shell.

DESCRIPTION OF RELATED ARTS

As the development of the USB Type-C connectors, more and more waterproof USB Type-C connectors are in need. In order to improve the waterproof performance, most of the USB Type-C connectors are provided with a sealing member forming by glue coagulation. When poured the glue into the USB Type-C connector, the glue would pour into a mating space of the connector easily.

It is desired to provide a waterproof electrical connector which could prevent the glue from overfilling.

SUMMARY OF THE DISCLOSURE

To achieve the above desire, an electrical connector includes an insulative housing, a metallic shielding shell enclosing the housing, and an insulative shell enclosing the metallic shielding shell. The metallic shielding shell forms a first mating cavity. The insulative shell includes a ring of rib protruding from an inner sidewall of the insulative shell. The ring of rib and the metallic shielding shell interfere with each other.

DETAILED DESCRIPTION OF THE PREFERRED EMBODIMENT

Reference will now be made in detail to the embodiments of the present disclosure. Referring to FIGS. 1-4, an electrical connector includes a contact module (not labeled), a metallic shielding shell 3 enclosing the contact module (not labeled), and an insulative shell 4 enclosing the metallic shielding shell 3. The electrical connector further includes a sealing member 5 located at a front side of the insulative shell 4 and a sealer 6 located at a rear side of the insulative shell 4. Both of the sealing member 5 and the sealer 6 are formed by glue coagulation.

Figure 8:
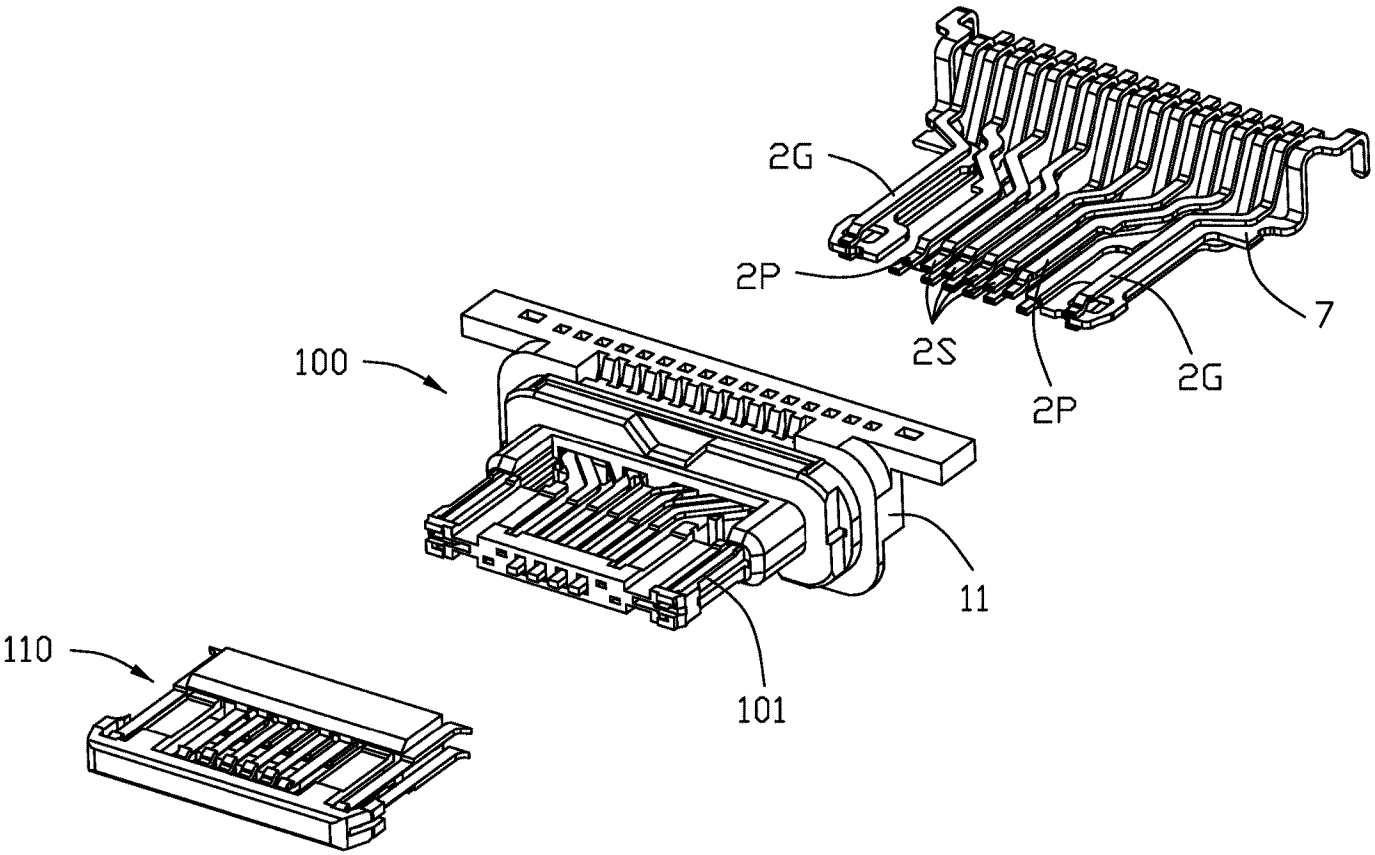
FIG. 8 is an exploded perspective view of a terminal module of FIG. 6.
Figure 9:
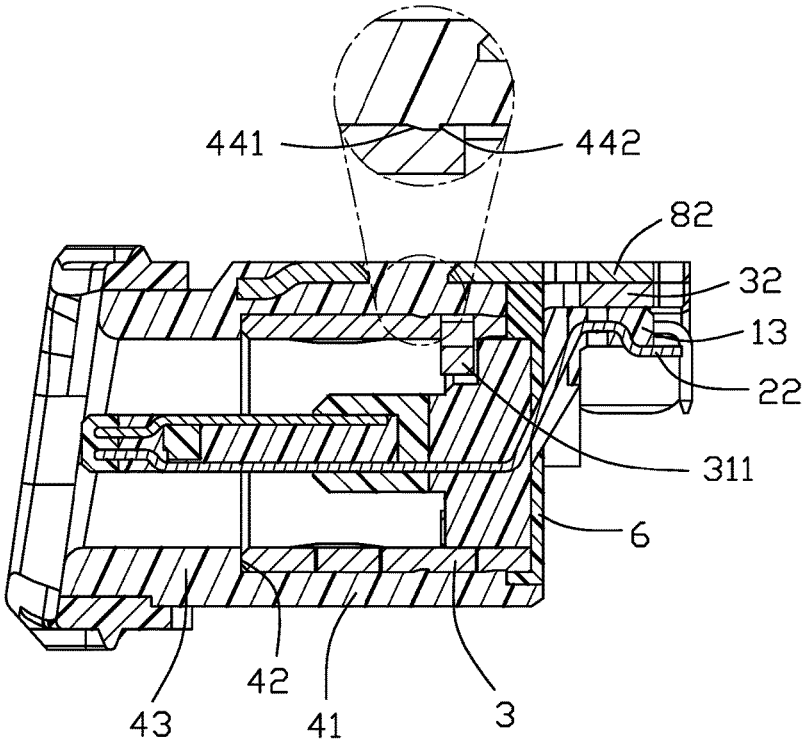
FIG. 9 is a cross-sectional view of the electrical connector of FIG. 1.

Referring to FIG. 8, the contact module (not labeled) includes an insulative housing 1, two rows of contacts 2 retained in the housing 1, and a metallic shielding plate 7 located between the two rows of the contacts 2 along a vertical direction. Each row of contacts 2 comprises two ground terminals 2G located at the two opposite sides along a transverse direction perpendicular to the vertical direction, two power terminals 2P located respectively neighbored to and between the two ground terminals 2G, and a plurality of signal terminals 2S located between the two power terminals 2P.

Figure 1:
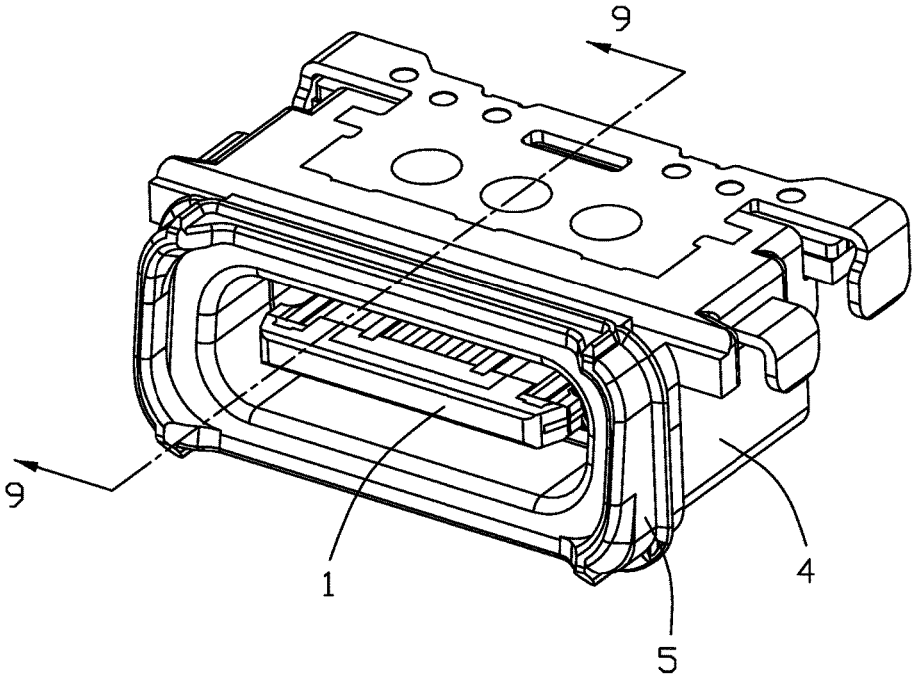
FIG. 1 is a front perspective view of an electrical connector of the invention.
Figure 2:
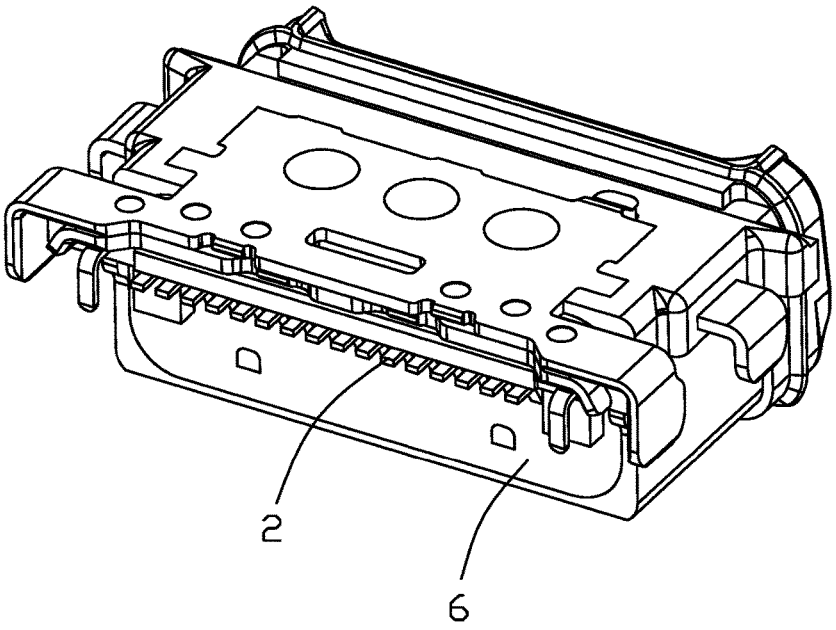
FIG. 2 is a rear perspective view of the electrical connector of FIG. 1.
Figure 3:
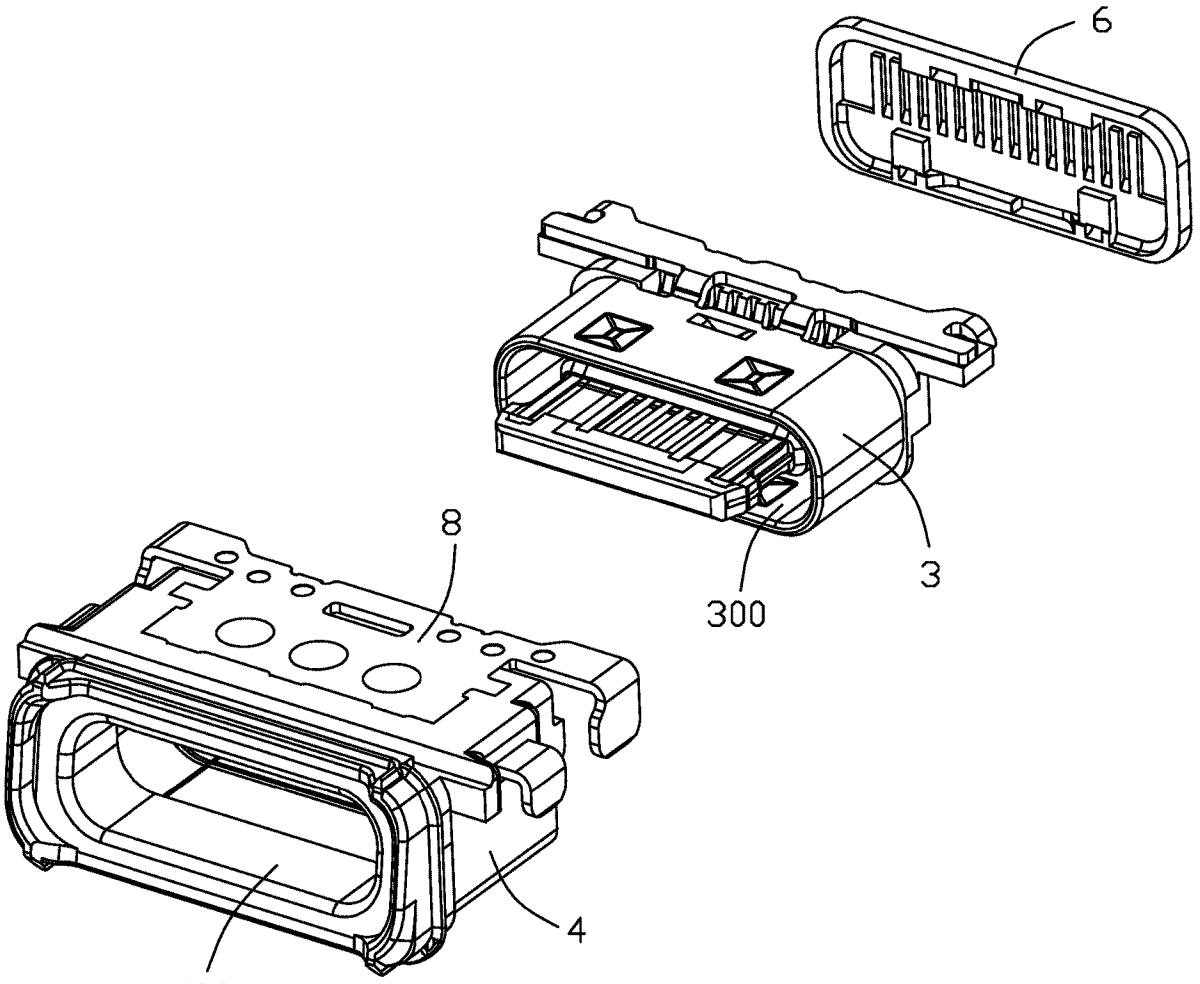
FIG. 3 is an exploded perspective view of the electrical connector of FIG. 1.
Figure 4:
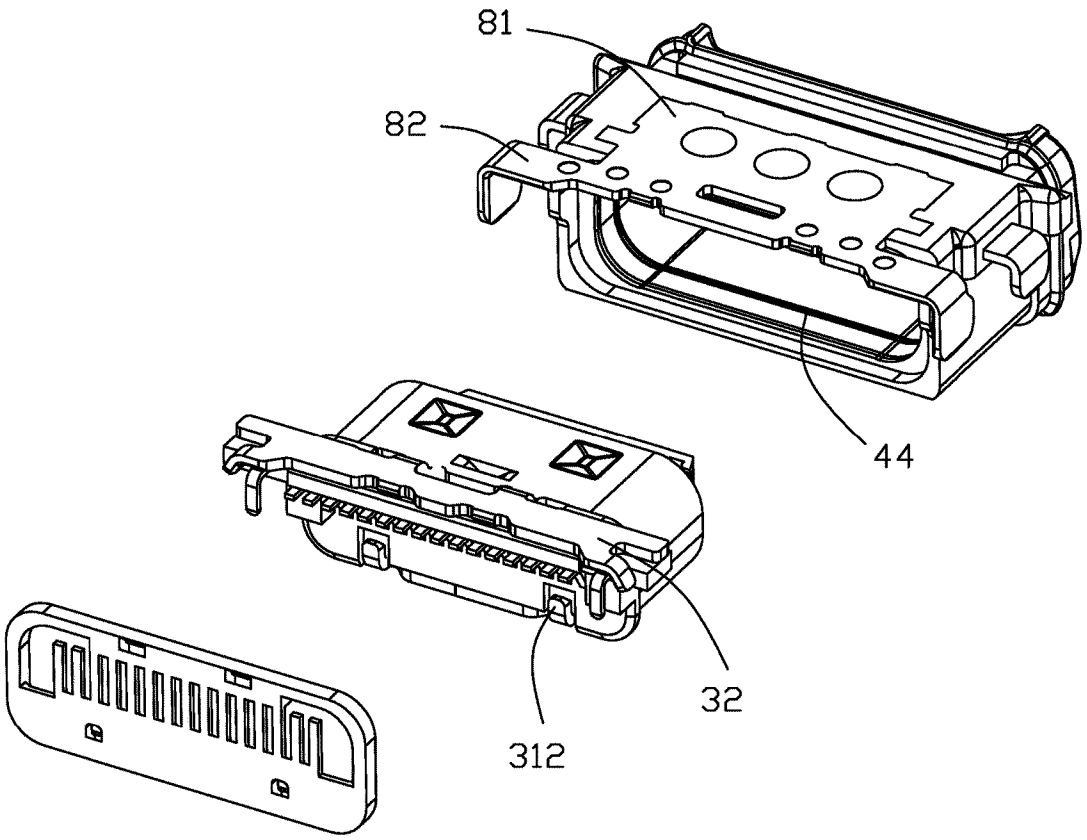
FIG. 4 is an exploded perspective view of the electrical connector of FIG. 2.
Figure 5:
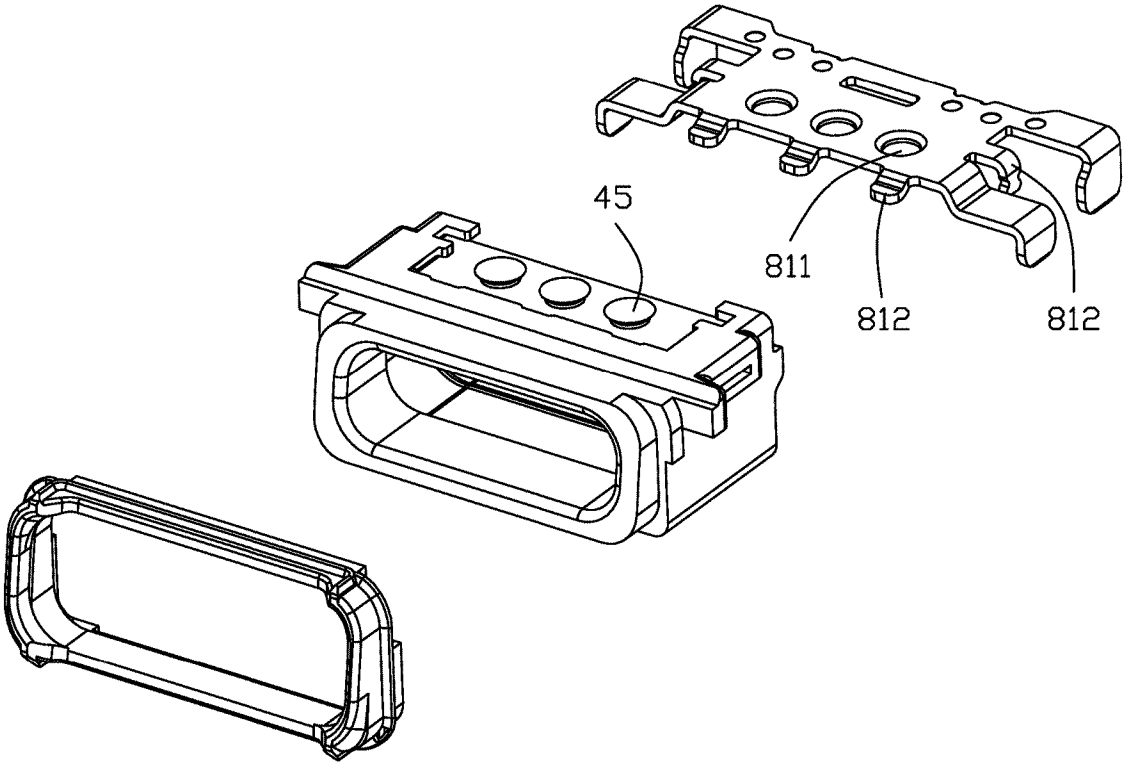
FIG. 5 is a partly exploded perspective view of the electrical connector of FIG. 3.
Figure 6:
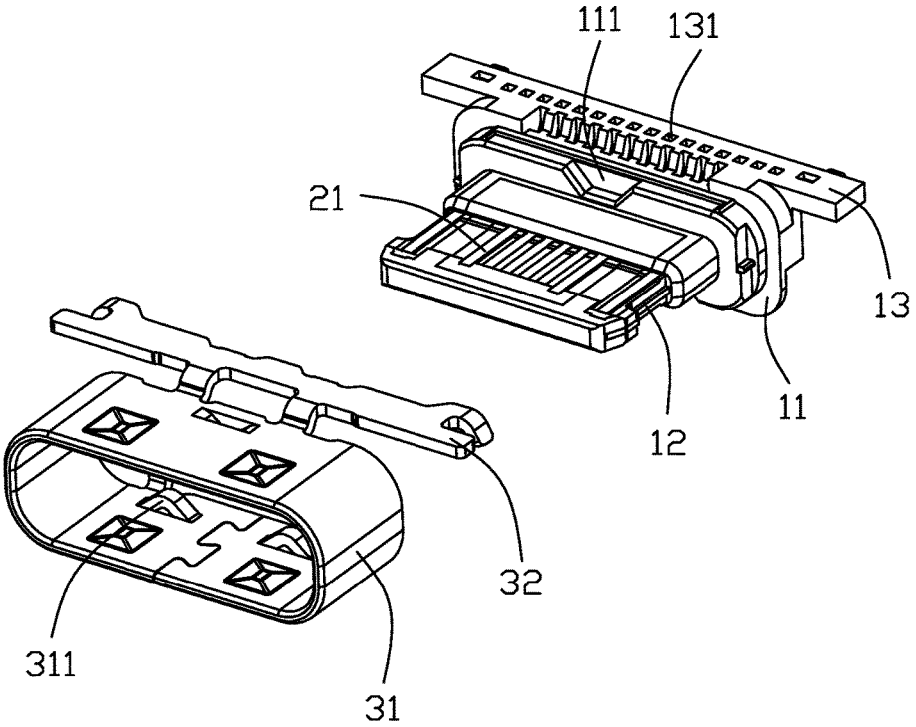
FIG. 6 is another partly exploded perspective view of the electrical connector of FIG. 3.
Figure 7:
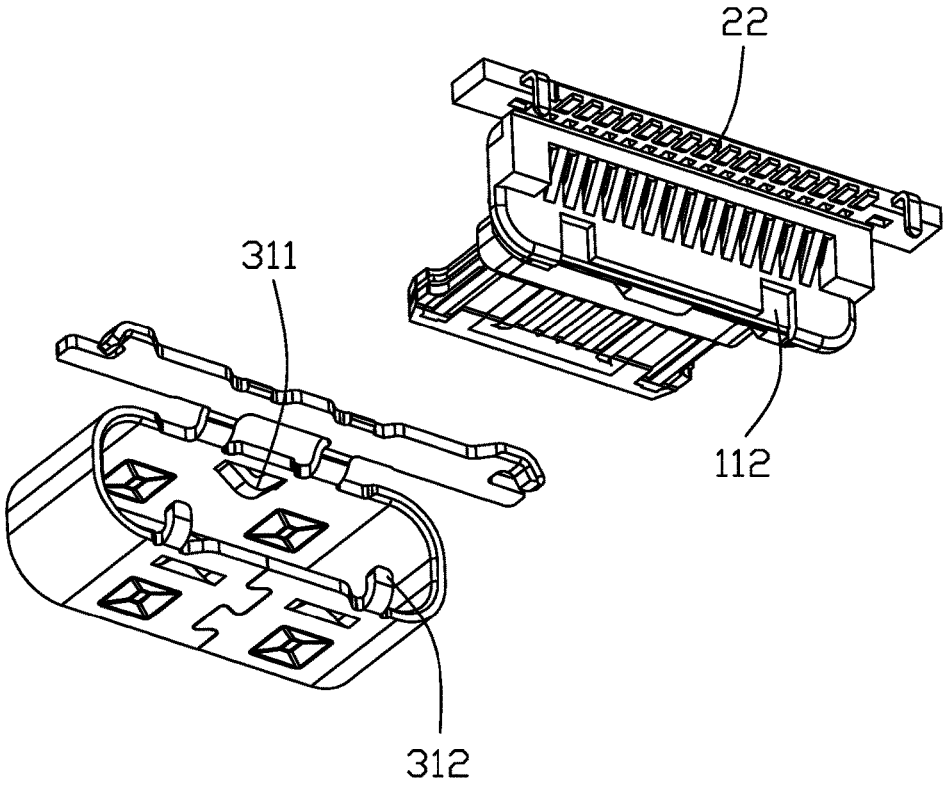
FIG. 7 is a rear perspective view of FIG. 6.

The insulative housing 1 includes a first insulator 100 integrally formed with the two rows of contacts 2 and the shielding plate 7 therein via an injection-molding process. The first insulator 100 includes a base 11 and a first tongue 101 extending forwardly therefrom. The housing 1 further includes a second insulator 110 enclosing the first tongue 101 and formed via an over-molding process. Referring to FIGS. 6 and 7, the housing 1 includes the base 11 and a mating tongue 12 formed by the first tongue 101 and the second insulator 110 molded together. The mating tongue 12 extends forwardly from the base 11. Each of the contacts 2 includes a mating section 21 exposed on two opposite surfaces of the mating tongue 12 and a connecting section 22 extending out of the base 11. One row of the mating sections 21 are disposed at a different level relative to the other row of the mating sections 21, while the two rows of connecting sections 22 are coplanar to each other. The base 11 includes a loading portion 13 extending therefrom in the transverse direction. The connecting sections 22 are retained in the loading portion 13 and go through the loading portion 13 to be located below the loading portion 13. The loading portion 13 includes a plurality of holes 131 going therethrough for heat dissipation of the contacts 2.

The metallic shielding shell 3 encloses the insulative housing 1 to form a first mating cavity 300. The metallic shielding shell 3 includes a shielding portion 31 enclosing the housing 1 and an extending portion 32 extending backwardly therefrom. The shielding portion 31 includes a plurality of protruding portions or stoppers 311 extending inwardly into the first mating cavity 300. The base 11 includes a plurality of grooves 111 for retaining the protruding portions 311 so that the metallic shielding shell 3 could be fixed to the housing 1. The shielding portion 31 includes two pins 312 bending upwardly from a lower section of the shielding portion 31. The base 11 includes two cutouts 112 for receiving the two pins 312. The extending portion 32 is located on the loading portion 13.

Referring to FIGS. 3-5, and 9, the insulative shell 4 includes a first shell 41 enclosing the shielding portion 31 and a second shell 42 extending forwardly therefrom. The mating tongue 12 extends forwardly out of the first mating cavity 300. The second shell 42 encloses the outside part of the mating tongue 12 to form a second mating cavity 400. The depth of the first mating cavity 300 in the vertical direction is larger than the depth of the second mating cavity 400 in the vertical direction. The distance between an inner sidewall of the second shell 42 and the mating tongue 12 is smaller than the distance between an inner sidewall of the first shell 41 and the mating tongue 12. The insulative shell 4 further includes a side face 43 connecting between the inner sidewalls of the first and second shells 41, 42. The side face 43 is vertical to both of the inner sidewall of the first shell 41 and the inner sidewall of the second shell 42. The front side of the metallic shielding shell 3 contacts with the side faces 43 of the insulative shell 4. The first shell 41 further includes a round rib 44 protruding from the inner sidewall of the first shell 41 to an outer sidewall of the metallic shielding shell 3 so that the insulative shell 4 interferes excessively with the metallic shielding shell 3. The rib 44 is formed integrally with the insulative shell 4 via an injection-molding process. The rib 44 includes a lead-in face 441 and a rear face 442 vertical to the inner sidewall of the first shell 41.

The electrical connector further includes a metallic member 8 retained to the insulative shell 4 via an injection-molding process. The metallic member 8 includes a main portion 81 retained to the insulative shell 4, a pair of mounting legs (not labeled) for mounting to a printed circuit board, and a mounting portion 82 extending backwardly therefrom. The main portion 81 includes a plurality of through-holes 811. The insulative shell 4 includes a plurality of bumps 45 protruding upwardly from a top wall of the insulative shell 4. The bumps 45 go across the corresponding through-holes 811. The metallic member 8 includes an upper surface coplanar to the outer sidewall of the insulative shell 4. The main portion 81 includes a plurality of extending pins 812 buried in the insulative shell 4 to increase the holding force between the insulative shell 4 and the metallic member 8. Notably, the metallic member 8 and the metallic shielding shell 3 are soldered with each other around corresponding rear portions.

The rib 44 of the insulative shell 4 protrudes into the first mating cavity 300 to interfere excessively with the metallic shielding shell 3 so that the liquid glue could not flow forwardly into the second mating cavity 400, and the insulative shell 4 would be mounted to the metallic shielding shell 3 firmly because of the rib 44.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing comprising a base and a mating tongue extending forwardly therefrom;

a plurality of contacts retained to the housing with corresponding mating sections exposed on two opposite surfaces of the mating tongue;

a metallic shielding shell with an outer sidewall enclosing the housing to form a first mating cavity; and an insulative shell with an inner sidewall enclosing the metallic shielding shell; wherein the insulative shell comprising a round rib protruding from the inner sidewall to the outer sidewall of the metallic shielding shell so that the insulative shell interferes excessively with the metallic shielding shell.

2. The electrical connector as claimed in claim 1, further comprising a sealer formed by glue coagulation, wherein the rib is vertical to the outer sidewall of the metallic shielding shell to prevent the glue from pouring forwardly into the first mating cavity.

3. The electrical connector as claimed in claim 2, wherein the insulative shell comprises a first shell enclosing the metallic shell and a second shell extending forwardly from the first shell.

4. The electrical connector as claimed in claim 3, wherein the mating tongue extends forwardly out of the first mating cavity, the second shell encloses the outside part of the mating tongue to form a second mating cavity, and the distance between an inner sidewall of the second shell and the mating tongue is smaller than the distance between an inner sidewall of the second shell and the mating tongue.

5. The electrical connector as claimed in claim 4, wherein the insulative shell comprises a side face connecting between the inner sidewalls of the first and second shells, and the side face is vertical to the inner sidewalls of the first and second shells.

6. The electrical connector as claimed in claim 5, wherein the front of the metallic shielding shell contacts the side face of the insulative shell.

7. The electrical connector as claimed in claim 1, further comprising a metallic member retained to the insulative shell by an injection-molding process, wherein the metallic member comprises a main portion retained to the insulative shell and a mounting portion extending backwardly therefrom, and the main portion comprises a plurality of through-holes.

8. The electrical connector as claimed in claim 7, wherein the insulative shell comprises a plurality of bumps going across the through-holes.

9. The electrical connector as claimed in claim 8, wherein the metallic shielding shell comprises an extending portion extending backwardly therefrom, and the extending portion is soldered to the mounting portion of the metallic member.

10. An electrical connector comprising:

a contact module including a plurality of contacts retained in an insulative housing:

a metallic shielding shell securely circumferentially enclosing the housing to form a mating cavity; and an insulative shell integrally formed with a metallic member having mounting legs or mounting to a printed circuit board, said insulative shell being rearwardly assembled upon the metallic shielding shell along a front-to-back direction, and circumferentially enclosing the metallic shielding shell; wherein the insulative shell comprises an circumferential inwardly extending rib against the metallic shielding shell so that the insulative shell not only interferes excessively with the metallic shielding shell but also prevents any invasion therebetween when applying a glue upon a rear side of the housing which may enter a gap between the insulative shell and the metallic shielding shell.

11. The electrical connector as claimed in claim 10, wherein said circumferential inwardly extending rib is deformed after the insulative shell is rearwardly assembled upon the metallic shielding shell along the front-to-back direction.

12. The electrical connector as claimed in claim 11, wherein said metallic shielding shell includes a plurality of stoppers for preventing forward movement of the housing of the contact module, and said circumferential inwardly extending rib is located in front of said stoppers in the front-to-back direction.

13. The electrical connector as claimed in claim 11, wherein the metallic shielding shell and the metallic member are soldered with each other so as to have the insulative housing, which is integrally formed with the metallic member, is immovable with regard to the insulative housing which is secured to the metallic shielding shell.

* * * * *